US010396490B2

(12) United States Patent
Okamura et al.

(10) Patent No.: US 10,396,490 B2
(45) Date of Patent: Aug. 27, 2019

(54) CONNECTOR ASSEMBLY AND CONNECTOR COVER

(71) Applicant: Molex, LLC, Lisle, IL (US)

(72) Inventors: Junpei Okamura, Yamato (JP); Takuji Hanyu, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/920,096

(22) Filed: Mar. 13, 2018

(65) Prior Publication Data

US 2018/0269623 A1 Sep. 20, 2018

(30) Foreign Application Priority Data

Mar. 16, 2017 (JP) ..... 2017-051878

(51) Int. Cl.

| | |
|---|---|
| ***H01R 13/426*** | (2006.01) |
| ***H01R 13/436*** | (2006.01) |
| ***H01R 13/502*** | (2006.01) |
| ***H01R 13/506*** | (2006.01) |
| ***H01R 13/52*** | (2006.01) |
| ***H01R 13/58*** | (2006.01) |

(52) U.S. Cl.

CPC ..... *H01R 13/5213* (2013.01); *H01R 13/502* (2013.01); *H01R 13/506* (2013.01); *H01R 13/5205* (2013.01); *H01R 13/5841* (2013.01); *H01R 13/426* (2013.01); *H01R 13/4367* (2013.01); *H01R 13/5219* (2013.01)

(58) Field of Classification Search

CPC ..... H01R 13/5833; H01R 13/5841; H01R 13/5213; H01R 13/502; H01R 13/506; H01R 13/5205; H01R 13/426; H01R 13/5219; H01R 13/4367

USPC ..... 439/457, 459, 468, 694

See application file for complete search history.

(56) References Cited

U.S. PATENT DOCUMENTS

| | | | | |
|---|---|---|---|---|
| 3,375,481 | A * | 3/1968 | Parnell | H01R 31/00 439/466 |
| 3,611,247 | A * | 10/1971 | Adams | H01R 13/502 439/106 |
| 6,174,193 | B1 * | 1/2001 | Nagano | H01R 13/506 439/468 |
| 6,478,608 | B1 * | 11/2002 | Grant | H01R 13/506 439/456 |
| 6,824,420 | B2 * | 11/2004 | Ushiro | H01R 13/5816 439/455 |
| 7,285,011 | B2 * | 10/2007 | Hardy | H01R 13/506 439/582 |

(Continued)

FOREIGN PATENT DOCUMENTS

| | | |
|---|---|---|
| JP | H02-016036 A | 1/1990 |
| JP | 2002-054206 A | 2/2002 |
| JP | 2015-103372 A | 6/2015 |

*Primary Examiner* — Gary F Paumen

(74) *Attorney, Agent, or Firm* — Molex, LLC

(57) ABSTRACT

A connector assembly may have a cover installed to a connector for curving a cable extending from a lead-out portion of a housing in a direction different from a lead-out direction of the cable. The cover may have a hood portion that covers the lead-out portion of the housing and a slit that is formed in the hood portion and where through the cable is inserted. The housing may have an outer shell portion that is disposed on an outer side of the hood portion of the cover and covers at least a portion of the hood portion.

7 Claims, 11 Drawing Sheets

(56) References Cited

U.S. PATENT DOCUMENTS

| | | | | |
|---|---|---|---|---|
| 8,790,129 | B1 * | 7/2014 | Rengifo | H01R 13/639<br>439/468 |
| 2014/0342595 | A1 * | 11/2014 | Wu | H01R 13/5833<br>439/456 |

* cited by examiner

CONNECTOR ASSEMBLY AND CONNECTOR COVER

RELATED APPLICATIONS

This application claims priority to Japanese Application No. 2017-051878, filed Mar. 16, 2017, which is incorporated herein by reference in its entirety.

TECHNICAL FIELD

The present disclosure relates to a connector assembly and a connector cover.

BACKGROUND ART

Patent document 1 below discloses a cover (electrical-wire cover 50 in patent document 1) installed to a connector (connector housing 10). An engaging hole is formed in the cover. An engaging claw of the connector protruding from an inner side of the cover is caught by an edge of this engaging hole. By this, the cover is prevented from falling off of the connector.

Patent Document 1: JP 2002-054206 A

SUMMARY

In patent document 1, in a state where the cover is covering the connector, an outer face of the cover covering the connector is exposed to an outer side of the connector. Here, when a product installed with the connector is washed with water or the like, a water flow comes to directly strike an edge and the outer face of the cover. This results in the cover deforming and the engaging hole of the cover disengaging from the engaging claw of the connector, and there is a possibility that the cover will disengage from the connector.

An object of the present disclosure is to provide a connector assembly and a connector cover that prevent disengagement of a cover caused by an external force acting thereon such as being struck by a water flow.

A connector assembly according to the present disclosure may have a connector having a terminal installed to a tip of a cable and a housing having a terminal housing portion, which includes a through hole that houses the terminal and an opening where through a terminal of another connector is inserted, and a lead-out portion, which includes a through hole where through the cable is inserted and an opening that lead out the cable; and a cover installed to the connector for curving the cable, which extends along a first direction that is a lead-out direction of the cable from the lead-out portion, in a direction different from the first direction. Here, the cover may have a hood portion that covers the lead-out portion and a slit that is formed in the hood portion and where through the curved cable is inserted. Moreover, the housing may have an outer shell portion that is disposed on an outer side of the hood portion of the cover and covers at least a portion of the hood portion. By this, curving of the cover caused by being struck by a water flow can be prevented and the cover disengaging from the connector can be prevented.

Moreover, in one aspect of the connector assembly, the hood portion of the cover may have a first plate portion and a second plate portion positioned away from the first plate portion interposing the slit. Here, the outer shell portion of the housing may cover at least a portion of the first plate portion of the cover and at least a portion of the second plate portion of the cover.

Moreover, in one aspect of the connector assembly, the cover may be installed to the connector in the first direction. Here, the hood portion and the slit of the cover may extend along the first direction.

Moreover, in one aspect of the connector assembly, the outer shell portion of the housing may have a portion that is disposed in a position away from the lead-out portion in a second direction that is a direction perpendicular to the first direction and covers the hood portion and a portion that is disposed in a position away from the lead-out portion in a third direction that is a direction perpendicular to the first direction and the second direction and covers the hood portion.

Moreover, in one aspect of the connector assembly, the lead-out portion and the outer shell portion of the housing may be connected by a rib extending along a removing direction that is a direction wherein the cover is removed from the housing. Here, the rib may be disposed in a position of passing through the slit of the cover.

Moreover, in one aspect of the connector assembly, the hood portion may have a plate-spring portion that engages an engaged portion formed on the housing and locks the cover to the housing so the cover does not disengage from the housing. The plate-spring portion may have a linking portion linked with the hood portion and an engaging portion that engages the engaged portion. The spring portion may be formed as a cantilever extending from the linking portion in the removing direction.

Moreover, in one aspect of the connector assembly, the outer shell portion of the housing may expose a portion of the hood formed with the plate-spring portion.

Moreover, in one aspect of the connector assembly, the hood portion may have a plate-spring portion that engages an engaged portion formed on the housing and locks the cover to the housing so the cover does not disengage from the housing. Here, the hood portion of the cover may have a convex portion that is provided with the plate-spring portion and protrudes along a direction perpendicular to the removing direction. Moreover, the outer shell portion of the housing may have a concave portion whereto the convex portion is fitted.

Moreover, in one aspect of the connector assembly, the hood portion of the cover may have a second slit extending along the removing direction. Here, the housing may have a second rib that extends along the removing direction and is fitted to the second slit.

Moreover, in one aspect of the connector assembly, the connector assembly may have the other connector that engages the housing; and the cable extending along the first direction from the lead-out portion. Here, the cable may be curved in a direction different from the first direction and inserted through the slit.

Moreover, a connector cover according to the present disclosure may be installed to a connector for curving a cable extending along a first direction that is a lead-out direction of the cable in a direction different from the first direction. Here, the connector cover may have a plate-spring portion that engages an engaged portion formed on a housing had by the connector and locks the connector cover to the housing so the connector cover does not disengage from the housing. Moreover, the plate-spring portion may have a linking portion linked with the hood portion and an engaging portion that engages the engaged portion and the spring portion may be formed as a cantilever extending from the linking portion in a removing direction that is a direction wherein the connector cover is removed from the connector.

DETAILED DESCRIPTION OF THE PREFERRED EMBODIMENTS

In the present embodiment, a direction wherein a connector 1 is inserted into another connector 9 (direction indicated by X1 in each diagram) is defined as frontward and a direction wherein the connector 1 is removed from the other connector 9 (direction indicated by X2 in each diagram) is defined as rearward. Moreover, among directions indicating a width of the connector 1, one (direction indicated by Y1 in each diagram) is defined as leftward and another (direction indicated by Y2 in each diagram) is defined as rightward. Moreover, among directions indicating a height of the connector 1, one (direction indicated by Z1 in each diagram) is defined as upward and another (direction indicated by Z2 in each diagram) is defined as downward. Note that the various directions are only for describing relative positional relationships of parts configuring the connector 1 and do not indicate absolute directions.

Figure 1:
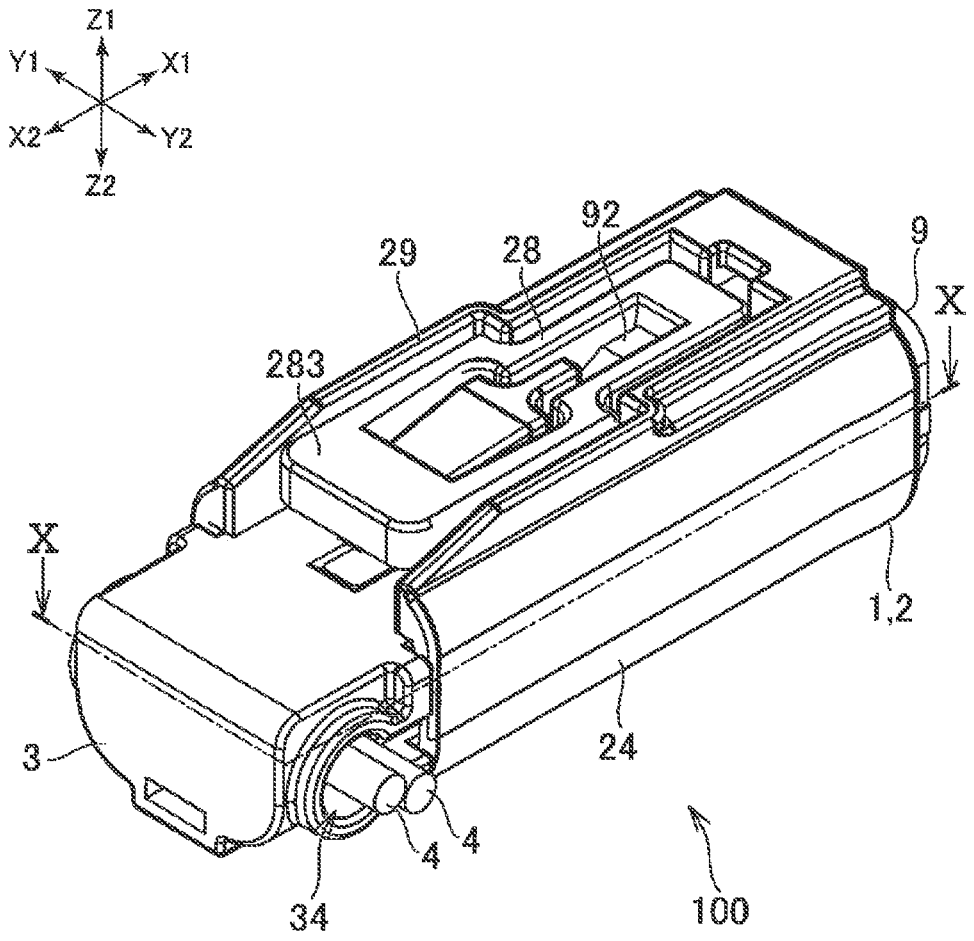
FIG. 1 is a perspective view illustrating a connector assembly 100 according to the present disclosure.
Figure 4:
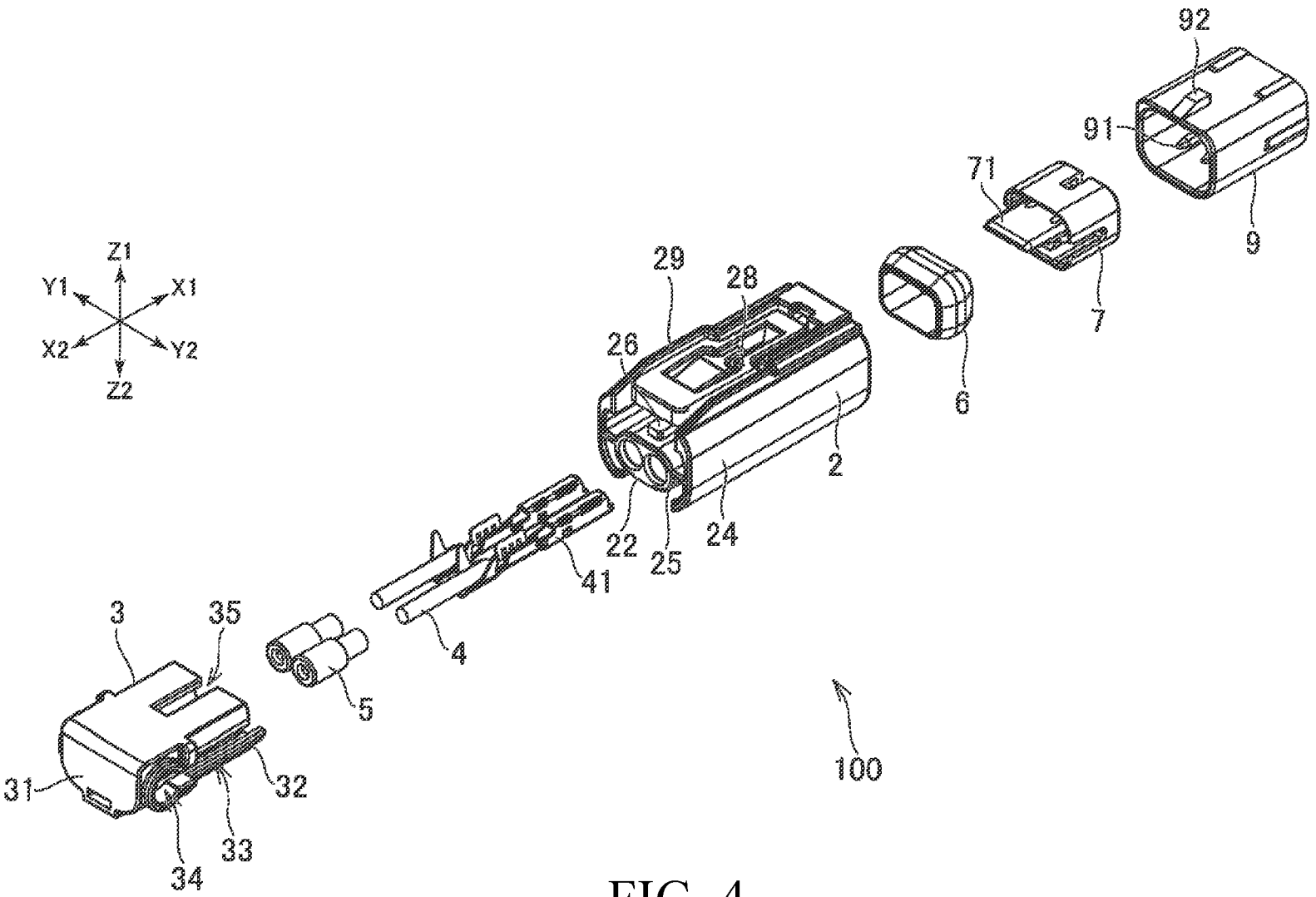
FIG. 4 is a perspective view illustrating components of the connector assembly 100.
Figure 11:
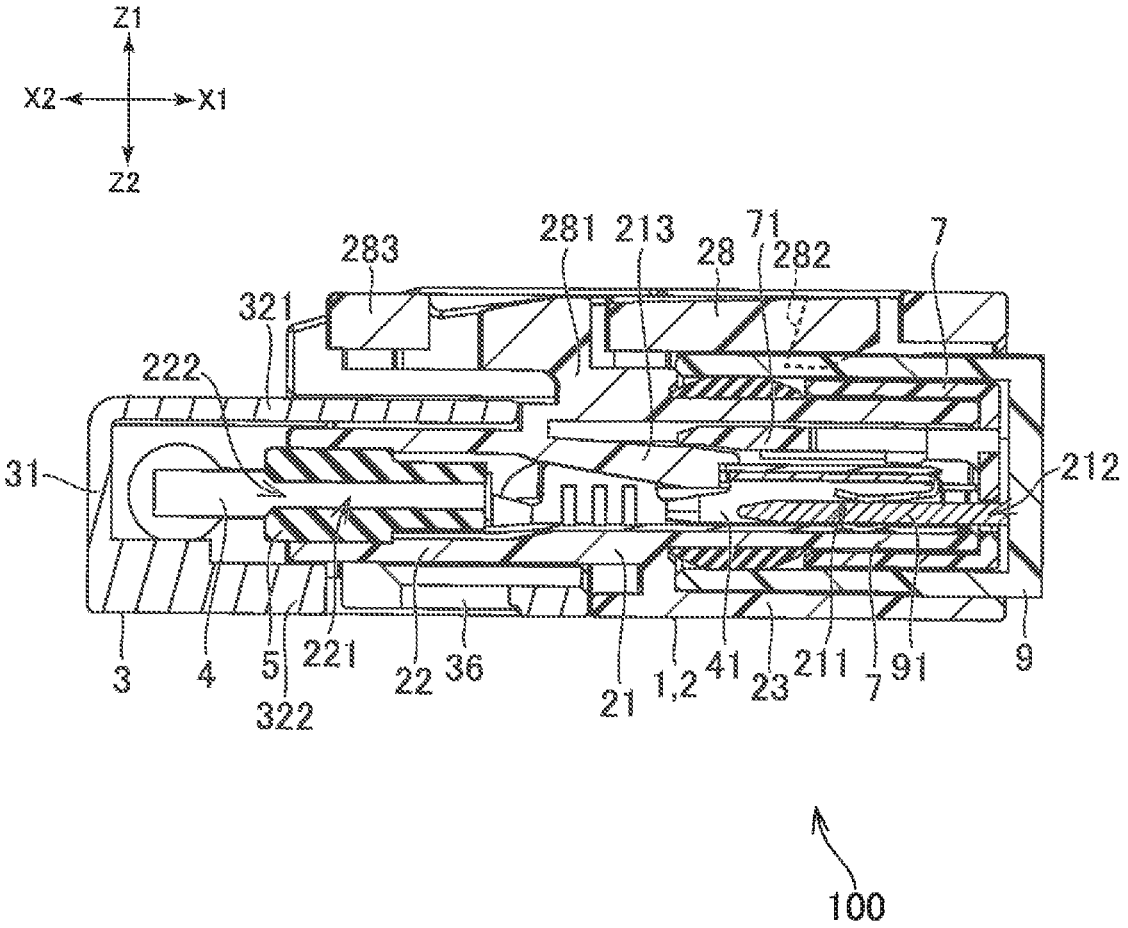
FIG. 11 is a diagram illustrating a cross section at line XI-XI illustrated in FIG. 2.

As illustrated in FIG. 1 and FIG. 4, a connector assembly 100 according to the present embodiment has the connector 1 and a cover 3. As illustrated in FIG. 4 and FIG. 11, the connector 1 may have a housing 2, a terminal 41, a rubber bushing 5, a seal 6, and a retainer 7. In the present embodiment, the rubber bushing 5 and the terminal 41, which are installed to a cable 4, are housed in the housing 2. Moreover, by the retainer 7 being installed to the housing 2, the terminal 41 is prevented from falling out of the housing 2. Moreover, the housing 2 is installed with a seal 6 to attempt waterproofing for when the other connector 9 is fitted. The seal 6 is fixed in the housing 2 by the retainer 7 being installed. However, components of the connector assembly 100 and the connector 1 are not necessarily limited thereto.

As illustrated in FIG. 1 and FIG. 4, the connector assembly 100 may be fitted to the other connector 9. The other connector 9 illustrated in each diagram is an example of a connector fitted to the connector assembly 100; as a form of the other connector 9, various forms are conceivable, such as a situation where a cable is connected, a situation of being installed to a board, and being installed to a control device.

As illustrated in FIG. 1, the connector 1 may have the cover 3 and the other connector 9 installed thereto. Here, the cover 3 and the other connector 9 may be installed to the housing 2 configuring the connector 1. In the present embodiment, the other connector 9 is fitted to the connector 1 on an opposite side of a side whereon the cover 3 of the connector 1 is installed, but a positional relationship between the cover 3 and the other connector 9 is not necessarily limited thereto. In the example illustrated in FIG. 1 and FIG. 4, two cables 4 are housed in the connector 1, but a number of cables 4 housed in the connector 1 may be one or a plurality of three or greater.

As illustrated in FIG. 4, on a tip of the cable 4 housed in the connector 1, the terminal 41, which consists of a conductor such as a metal, may be installed. The terminal 41 may be electrically connected to the cable 4 by contacting a conductor such as a copper wire included in the cable 4. Moreover, the other connector 9 may have a terminal 91. As illustrated in FIG. 11, the terminal 41 may be connected to the terminal 91 in a state where the cable 4 is housed in the connector 1 and the other connector 9 is fitted to the connector 1. Note that in the present embodiment, the terminal 41 is formed in a substantially cylindrical female shape and the terminal 91 is formed in a substantially acicular male shape; however, inversely, the terminal 41 may be formed in the female shape and the terminal 91 may be formed in the female shape. In other words, in the present embodiment, the connector 1 is made to be a receptacle connector that is a female connector and the other connector 9 is made to be a plug connector that is a male connector; however, not being limited thereto, the connector 1 may be made to be a plug connector and the other connector 9 may be made to be a receptacle connector.

As illustrated in FIG. 11, the housing 2 configuring the connector 1 may have on a frontward side a terminal housing portion 21 that houses the terminal 41 installed on the tip of the cable 4 and on a rearward side a lead-out portion 22 that is connected to this terminal housing portion 21 and where through the cable 4 is inserted. In a state where the terminal 41 is housed in the terminal housing portion 21, the cable 4 may be led out from the lead-out portion 22. In the present embodiment, the cable 4 is led out to a rearward direction of the lead-out portion 22, but a direction whereto the cable 4 is led out is not limited thereto. Moreover, in the present embodiment, the terminal housing portion 21 and the lead-out portion 22 extend along a front-rear direction, but an extension direction of the terminal housing portion 21 and the lead-out portion 22 is also not limited thereto.

Figure 5:
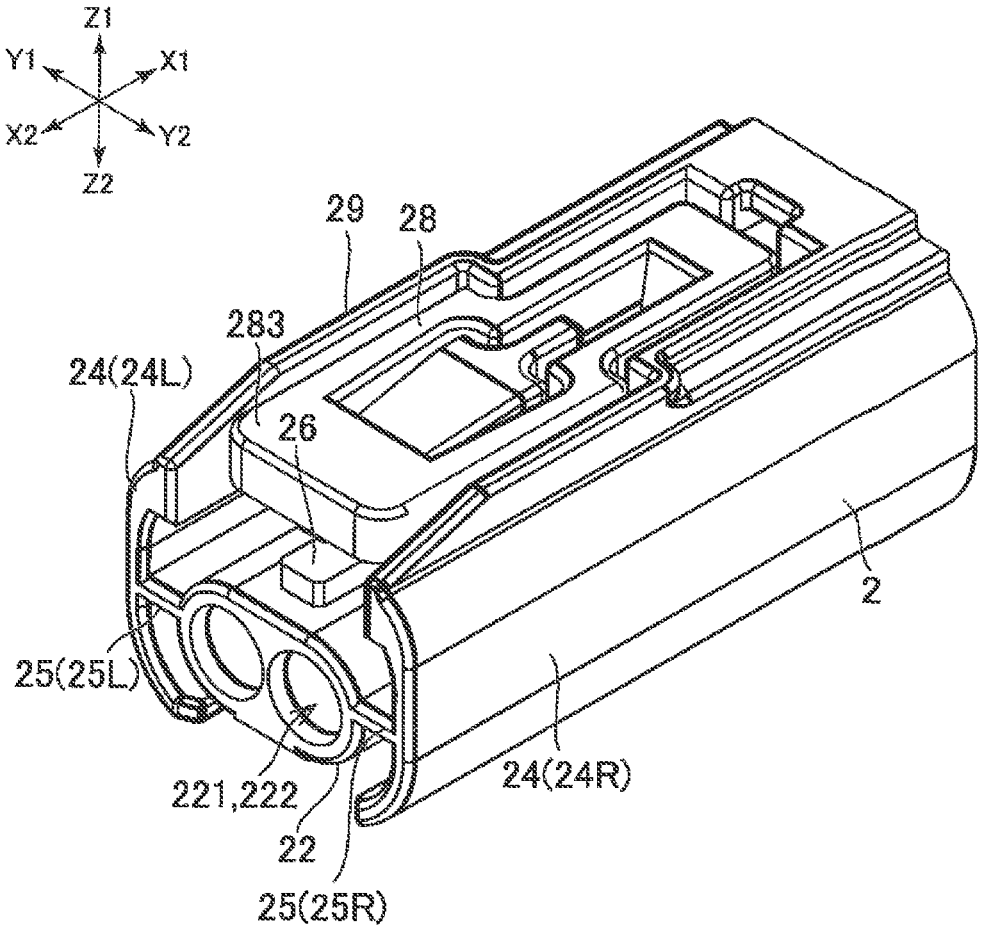
FIG. 5 is a perspective view illustrating an upper side of a housing 2.

As illustrated in FIG. 5 and FIG. 11, the terminal housing portion 21 may have a through hole 211 that is a space extending along the front-rear direction and an opening 212 positioned at a front end of this through hole 211. Moreover, the lead-out portion 22 may have a through hole 221 that is a space extending along the front-rear direction and an opening 222 positioned at a rear end of this through hole 221. Here, the through hole 211 of the terminal housing portion 21 may be communicated to the through hole 221 of the lead-out portion 22 and the terminal 41 installed on the tip of the cable 4 may be inserted through the through hole 221 from the opening 222 of the lead-out portion 22 and mounted in the through hole 211 of the terminal housing portion 21. Moreover, the terminal 91 of the other connector 9 may be inserted through the through hole 211 from the opening 212 of the terminal housing portion 21 and fitted to the terminal 41 mounted in the through hole 211. That is, the terminal housing portion 21 may be a fitting portion that is fitted to the other connector 9.

Moreover, the cable 4 may be inserted through the through hole 221 of the lead-out portion 22 and led out rearwardly from the opening 222 of the lead-out portion 22. In the example illustrated in FIG. 5 and FIG. 11, the through hole 221 and the opening 222 of the lead-out portion 22 are lined up in two rows. Not being limited thereto, the through hole 221 and the opening 222 of the lead-out portion 22 may be in one row or three or more rows; it is sufficient for the number of cables 4 inserted through the lead-out portion 22 to be no greater than a number of rows of the through hole 221 and the opening 222. Note that in the present embodiment, a shape of the through hole 221 and the opening 222 formed in the lead-out portion 22 is made to be substantially cylindrical but the shape of the through hole 221 and the opening 222 is not limited thereto. For example, the through hole 221 and the opening 222 may be formed in a substantially rectangular-prism shape.

Moreover, as illustrated in FIG. 5, the housing 2 may be formed in a substantially cylindrical shape and have an outer shell portion 24 extending along the front-rear direction. In the present embodiment, the outer shell portion 24 includes a left-side outer shell portion 24L that covers a left side of the lead-out portion 22 and a right-side outer shell portion 24R that covers a right side of the lead-out portion 22. However, a shape of the outer shell portion 24 is not necessarily limited thereto. The outer shell portion 24 may include a portion that covers an upper side of the lead-out portion 22. Details of the outer shell portion 24 are described below.

As illustrated in FIG. 4, the rubber bushing 5 may be formed in a substantially cylindrical shape. As illustrated in FIG. 11, the rubber bushing 5 may block a gap between the through hole 221 of the lead-out portion 22 formed in the housing 2 and the cable 4. By this, intrusion of water into the through hole 221 of the lead-out portion 22 and the through hole 211 of the terminal housing portion 21 communicated thereto can be prevented. Note that a shape of the rubber bushing 5 is not limited to the example illustrated in FIG. 4. For example, the rubber bushing 5 may be formed conforming to a shape of the cable 4 and the through hole 221 of the lead-out portion 22.

As illustrated in FIG. 4, the seal 6 may be formed in an annular shape. As illustrated in FIG. 11, the seal 6 may block a gap between the terminal housing portion 21 formed in the housing 2 and the other connector 9. By this, intrusion of water to an inner side of the other connector 9 can be prevented.

As illustrated in FIG. 4, the retainer 7 may have a claw portion 71 extending along the front-read direction. As illustrated in FIG. 11, the claw portion 71 of the retainer 7 may be housed on an inner side of the terminal housing portion 21. The claw portion 71 may fix a position of a movable engaging portion 213 by pushing down the movable engaging portion 213, which is formed in the terminal housing portion 21. By this, the movable engaging portion 213 can be fixed in a position of engaging the terminal 41 and the terminal 41 can be prevented from falling out.

As illustrated in FIG. 1 and FIG. 4, in the present embodiment, the cover 3, which is for changing a direction of the cable 4 led out from the lead-out portion 22, is installed to the connector 1 in the front-rear direction. In other words, in the present embodiment, the cover 3 is installed along the direction of the cable 4 led out from the lead-out portion 22 of the housing 2 (in the present embodiment, the front-rear direction). The cover 3 is not limited to the front-rear direction and may be installed to the connector 1 in an up-down direction or a left-right direction or installed to the connector 1 in a diagonal direction.

Figure 7:
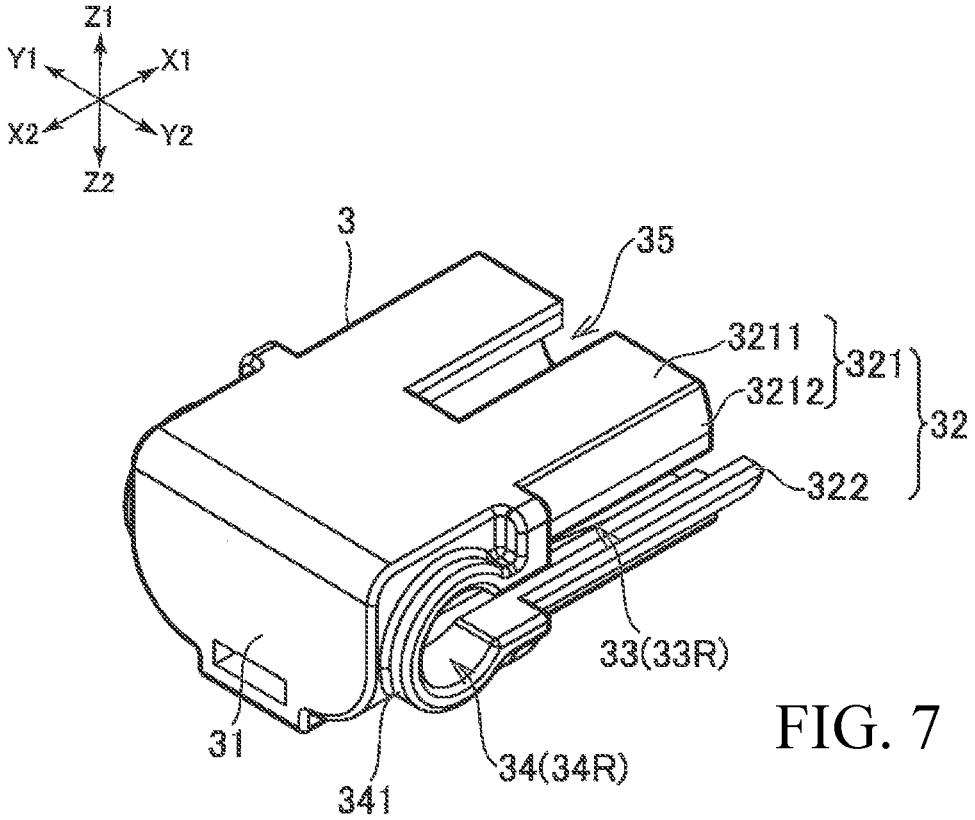
FIG. 7 is a perspective view illustrating an upper side of a cover 3.

As illustrated in FIG. 7, the cover 3 may have a wall portion 31 and a hood portion 32 extending from the wall portion 31. In the present embodiment, the hood portion 32 is formed in a substantially cylindrical shape and extends along the front-rear direction. Moreover, the wall portion 31 is formed to be substantially plate-like and is positioned in a position of blocking a rear-end side of the hood portion 32 formed in the substantially cylindrical shape. However, the shapes of the wall portion 31 and the hood portion 32 are not necessarily limited thereto. For example, the hood portion 32 may be configured from two plates positioned away from each other in the up-down direction. Moreover, the wall portion 31 may be disposed in an intermediate position between a front end and a rear end of the hood portion 32 extending along the front-rear direction.

As illustrated in FIG. 7, the hood portion 32 may be provided with a slit 33 and an extraction port 34. The slit 33 may extend in an installation direction, which is a direction wherein the cover 3 is installed to the connector 1 (in the present embodiment, frontward). In the present embodiment, the slit 33 extends along the direction wherein the cable 4 is led out from the lead-out portion 22 of the housing 2. Moreover, the slit 33 may be formed across a front end of the cover 3 from the extraction port 34. The extraction port 34 is a hole for extracting the cable 4 and may be formed wider than the slit 33. As illustrated in FIG. 5, the extraction port 34 may be formed to be substantially circular and may have a diameter wider than a width of the slit 33.

Figure 8:
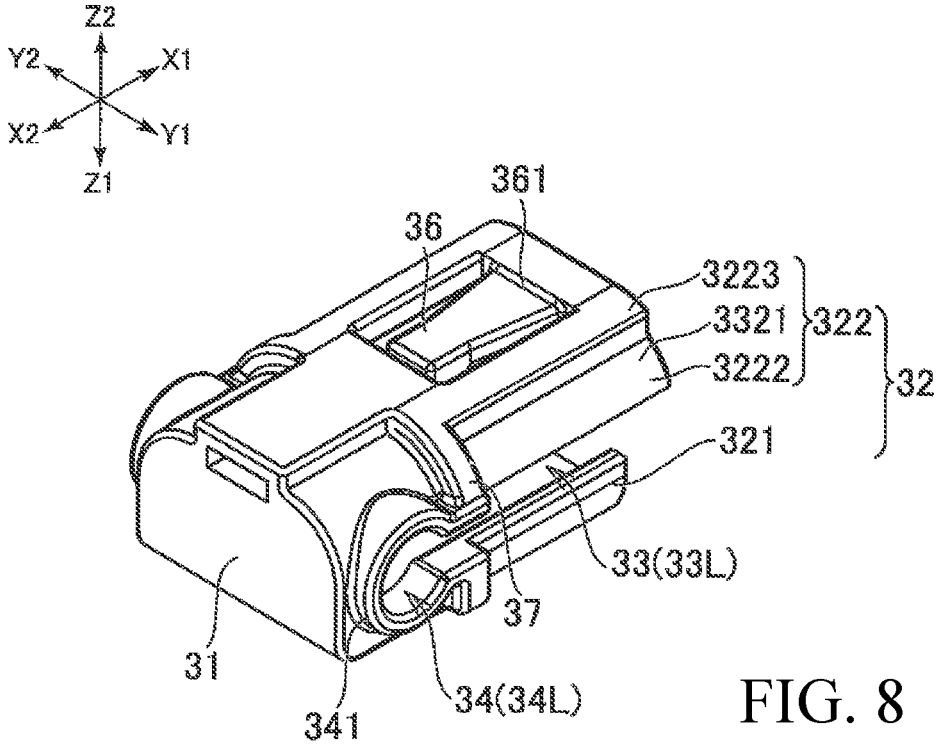
FIG. 8 is a perspective view illustrating a lower side of the cover 3.

As illustrated in FIG. 7 and FIG. 8, in the present embodiment, on a left side of the hood portion 32, a left-side slit 33L and a left-side extraction port 34L communicated thereto are formed and on a right side of the hood portion 32, a right-side slit 33R and a right-side extraction port 34R communicated thereto are formed. Not being limited thereto, the slit 33 and the extraction port 34 may be formed on only one side from among the left side and the right side of the hood portion 32. By the hood portion 32 of the cover 3 being divided up and down by the slit 33 as in the present embodiment, the hood portion 32 comes to have an upper plate portion 321 positioned on an upper side of the slit 33 and a lower plate portion 322 positioned away from the upper plate portion 321 interposing the slit 33. Note that in the present embodiment the lower plate portion 322 is formed longer than the upper plate portion 321 in the front-rear direction but the lower plate portion 322 may be formed shorter than the upper plate portion 321 or have the same length as the upper plate portion 321.

Figure 9:
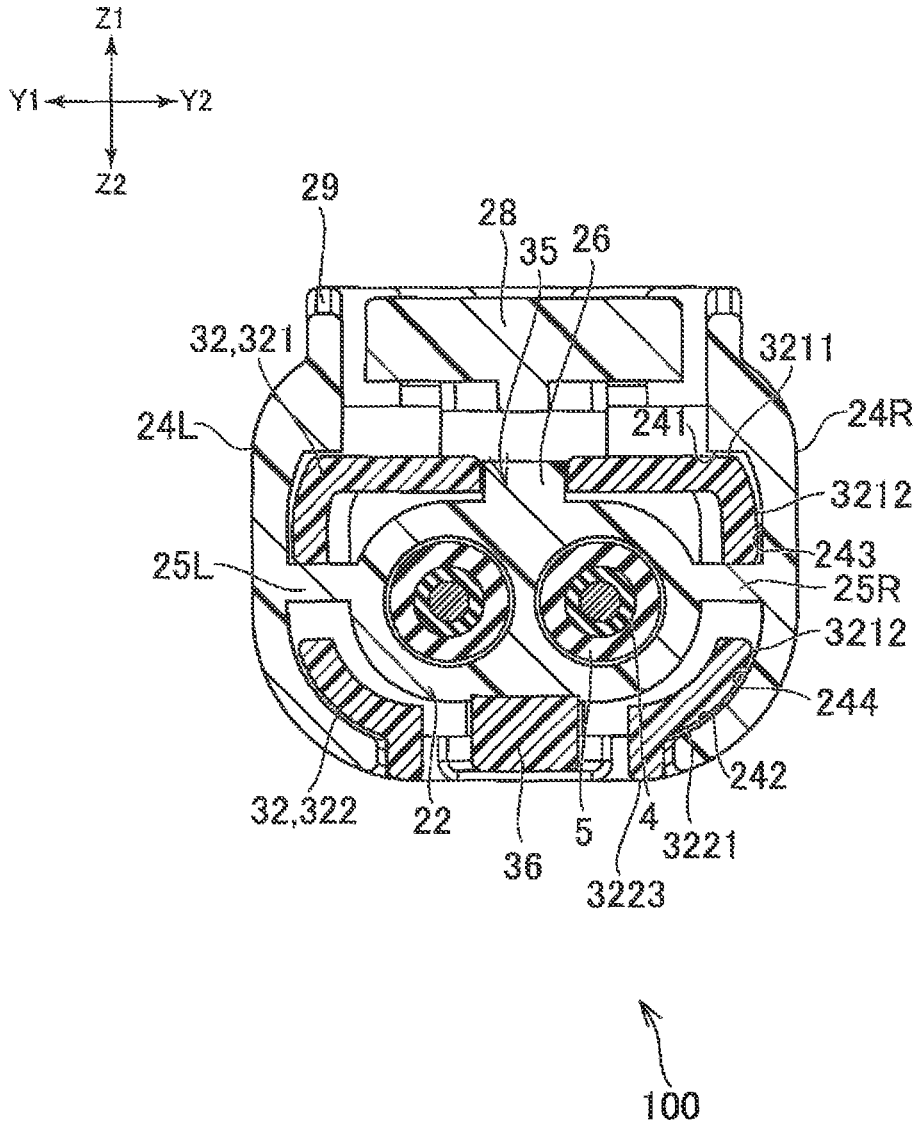
FIG. 9 is a diagram illustrating a cross section at line XI-XI illustrated in FIG. 2.
Figure 10:
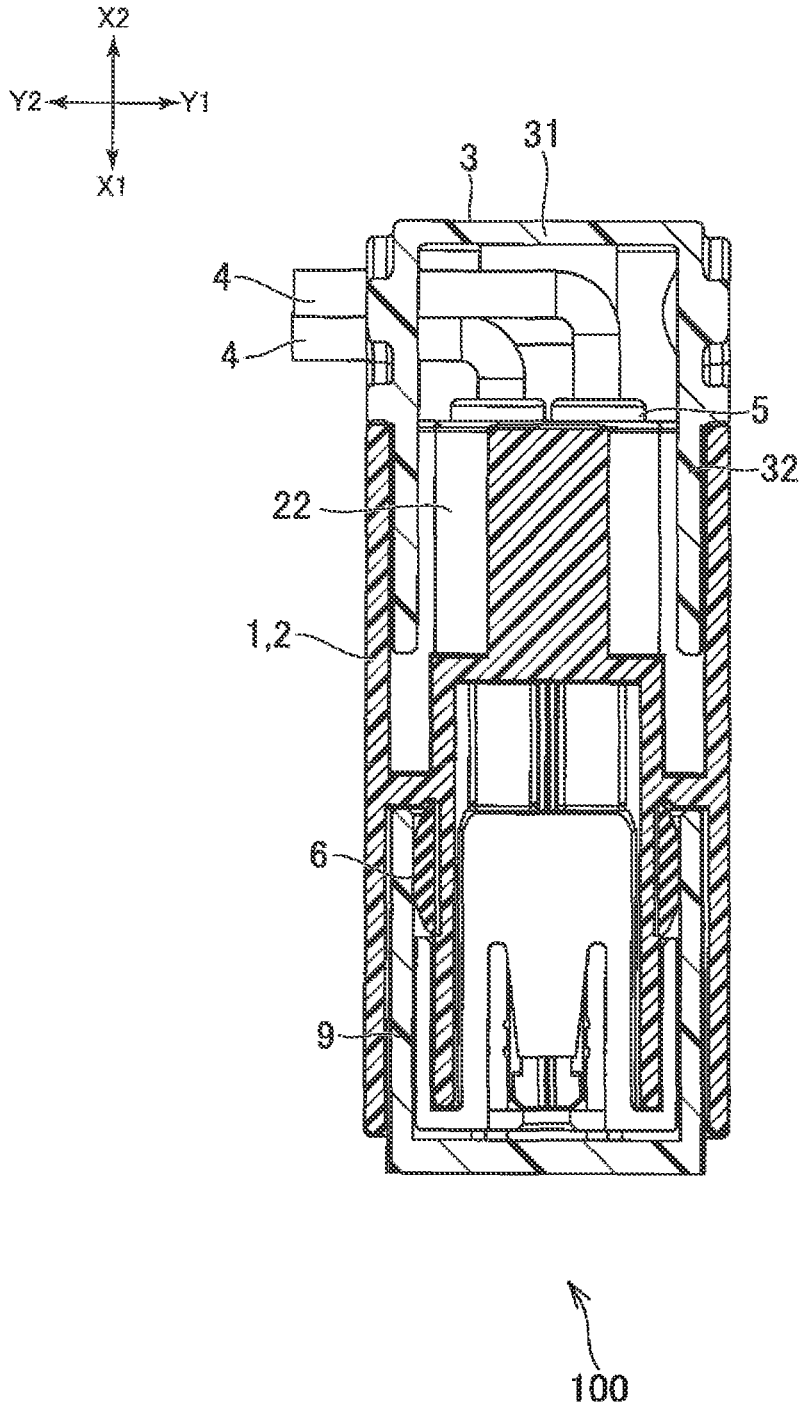
FIG. 10 is a diagram illustrating a cross section at line X-X illustrated in FIG. 1.

As illustrated in FIG. 9 and FIG. 10, in a state where the cover 3 is installed to the connector 1, the hood portion 32 may cover the lead-out portion 22 formed in the housing 2. Moreover, as illustrated in FIG. 10, in the state where the cover 3 is installed to the connector 1, the wall portion 31 may be positioned rearwardly away from the lead-out portion 22 of the housing 2. Here, the cable 4 may be bent in a left direction or a right direction by being blocked by the wall portion 31. That is, the cover 3 may curve the cable 4 in a direction different from the direction wherein the cable 4 is led out from the lead-out portion 22 of the housing 2 (in the present embodiment, rearward).

As illustrated in FIG. 10, the cable 4 curved by striking the wall portion 31 or an edge of the extraction port 34 of the cover 3 may be extracted from the extraction port 34. In the example illustrated in FIG. 10, each of the plurality of cables 4 housed in the connector 1 is extracted from the right-side extraction port 34R; however, not being limited thereto, all of the plurality of cables 4 may be extracted from the left-side extraction port 34L. Additionally, a portion of the plurality of cables 4 may be extracted from the right-side extraction port 34R and a remainder may be extracted from the left-side extraction port 34L.

As illustrated in FIG. 7, on the edge of the extraction port 34 wherefrom the cable 4 is extracted from the cover 3, a reinforcing wall portion 341 protruding to an outer side of the cover 3 may be formed. The reinforcing wall portion 341 may extend to at least a portion of the slit 33. By forming the reinforcing wall portion 341 in this manner, a strength of the cover 3 in a periphery of the extraction port 34 wherefrom the cable 4 is extracted is ensured and damage of the cover 3 can be prevented. Moreover, by the edge of the extraction port 34 not being a thin edge, damage of the cable 4 can also be prevented.

Moreover, when installing the cover 3 to the connector 1, the cable 4 curved by the cover 3 may reach the extraction port 34 after being inserted through the slit 33 of the hood portion 32. In other words, the cable 4 may be inserted through a gap between the upper plate portion 321 and the lower plate portion 322. By this, a worker can install the cover 3 to the connector 1 in a state where the cable 4 is curved in the left-right direction.

As above, by forming the slit 33 in the hood portion 33 of the cover 3, the worker can install the cover 3 in a state where the cable 4 is curved. However, because the hood portion 32 is divided up and down into the upper plate portion 321 and the lower plate portion 322 by the slit 33, the hood portion 32 is more likely to open in the up-down direction. For example, by a water flow striking the cover 3, there is a possibility of the upper plate portion 321 and the lower plate portion 322 illustrated in FIG. 7 deforming in directions away from each other and the cover 3 disengaging from the connector 1.

Therefore, as illustrated in FIG. 9, in a state where the hood portion 32 of the cover 3 is covering the lead-out portion 22 of the housing 2, the outer shell portion 24 of the housing 2 may cover at least a portion of the hood portion 32. The outer shell portion 24 may particularly cover at least a portion of the upper plate portion 321 and at least a portion of the lower plate portion 322 included in the hood portion 32. More specifically, the left and right outer shell portions 24L, 24R may have an inner face 241 that opposes an upper face 3211 of the upper plate portion 321 and covers an upper side of the hood portion 32 and an inner face 242 that opposes a lower face 3221 of the lower plate portion 322 and covers a lower side of the hood portion 32. The inner face 241 on the upper side may be disposed in a position upwardly away from the lead-out portion 22 of the housing 2, and the inner face 242 on the lower side may be disposed in a position downwardly away from the lead-out portion 22. In this manner, by the outer shell portion 24 supporting the upper side and the lower side of the hood portion 32, the upper plate portion 321 and the lower plate portion 322 of the hood portion 32 are prevented from deforming in the directions away from each other and disengagement of the cover 3 can be prevented.

Note that in the example illustrated in FIG. 9, in the outer shell portion 24, one inner face 241 on the upper side covering the upper face 3211 of the hood portion 32 is respectively provided on the left side and the right side of the outer shell portion 24, but the shape of the outer shell portion 24 is not limited thereto. For example, the outer shell portion 24 may cover an entirety of the upper face 3211 of the hood portion 32 or cover the upper face 3211 in a plurality of positions that is three or greater. Similarly, the outer shell portion 24 may cover an entirety of the lower face 3221 of the lower plate portion 322 by one face or cover the lower face 3221 in a plurality of positions that is three or greater.

Moreover, the left and right outer shell portions 24L, 24R may have an inner face 243 that opposes a lateral face 3212 of the upper plate portion 321 of the hood portion 32 in the left-right direction and an inner face 244 that opposes a lateral face 3222 of the lower plate portion 322 of the hood portion 32 in the left-right direction. The inner faces 243, 244 may be disposed in positions leftwardly or rightwardly away from the lead-out portion 22 of the housing 2. In this manner, by the outer shell portion 24 covering the right side and the left side of the hood portion 32 of the cover 3, a water flow directly striking the hood portion 32 can be suppressed. Moreover, in the outer shell portion 24, the inner face 241 on the upper side may be connected to the inner face 243 on the left side or the right side and the inner face 242 on the lower side may be connected to the inner face 244 on the left side or the right side. By this, a strength of the outer shell portion 24 can be improved and deformation of the outer shell portion 24 can be prevented. That is, deformation of the hood portion 32 of the cover 3 can be prevented more reliably.

As illustrated in FIG. 5, the housing 2 may have a left-side rib 25L and a right-side rib 25R as a rib 25 extending along the installation direction (in the present embodiment, frontward) and a removing direction (in the present embodiment, rearward) of the cover 3. The left-side rib 25L may be positioned on the left side of the lead-out portion 22, and the right-side rib 25R may be positioned on the right side of the lead-out portion 22. Here, the lead-out portion 22 of the housing 2 and the left-side outer shell portion 24L may be connected by the left-side rib 25L. Moreover, the lead-out portion 22 and the right-side outer shell portion 24R may be connected by the right-side rib 25L. By connecting the outer shell portion 24 and the lead-out portion 22 in this manner, the strength of the outer shell portion 24 can be ensured. By this, deformation of the hood portion 32 of the cover 3 can be suppressed more reliably and disengagement of the cover 3 installed to the connector 1 can be prevented.

As illustrated in FIG. 9, the left-side rib 25L may be disposed in a position of passing through the left-side slit 33L formed in the hood portion 32 of the cover 3 and the right-side rib 25R may be disposed in a position of passing through the right-side slit 33R of the cover 3. In other words, the left and right ribs 25L, 25R may be disposed between the upper plate portion 321 and the lower plate portion 322 included in the hood portion 32. By this, when the worker installs the cover 3, a position of the cover 3 in the up-down direction can be specified. In the example illustrated in FIG. 9, the left and right ribs 25L, 25R contact a lower end of the upper plate portion 321 by an upper face, but the left and right ribs 25L, 25R may be disposed in a position away from the upper plate portion 321. Moreover, the left and right ribs 25L, 25R are away from the lower plate portion 322, but the left and right ribs 25L, 25R may contact an upper end of the lower plate portion 322. By the left and right ribs 25L, 25R contacting at least one from among the upper plate portion 321 and the lower plate portion 322, the cover 3 installed to the connector 1 can be suppressed from moving in the up-down direction.

As illustrated in FIG. 7, the cover 3 may have a second slit 35 disposed in a position different from those of the left and right slits 33L, 33R. The second slit 35 may, like the left and right slits 33L, 33R, extend along the direction wherein the cover 3 is installed to the connector 1 (in the present embodiment, the front-rear direction). The second slit 35 may have a width in a direction (in the present embodiment, the left-right direction) different from a width direction of the left and right slits 33L, 33R (in the present embodiment, the up-down direction). In the present embodiment, the second slit 35 is formed in the upper plate portion 321 on the upper side of the hood portion 32. Not being limited thereto, the second slit 35 may be formed in the lower plate portion 322 on the lower side of the hood portion 32.

Moreover, as illustrated in FIG. 5, the housing 2 may have a second rib 26 disposed in a position different from those of the left and right ribs 25L, 25R. The second rib 26 may extend along the direction wherein the cover 3 is installed to the connector 1 (in the present embodiment, the front-rear direction). The second rib 26 may have a shape that protrudes from an upper face of the lead-out portion 22 disposed on an inner side of the housing 2.

Here, as illustrated in FIG. 9, the second rib 26 formed on the housing 2 may be fitted to the second slit 35 formed in the cover 3. By this, when the worker installs the cover 3, a position of the cover 3 in the left-right direction can be specified. Moreover, by the second rib 26 having a width substantially identical to the width of the second slit 35, the cover 3 installed to the connector 1 can be suppressed from moving in the left-right direction. Note that the second slit 35 formed in the cover 3 may be formed in the lower plate portion 322 on a lower side of the cover 3. In this situation, the second rib 26 formed on the housing 2 may be disposed on a lower side of the lead-out portion 22 and fitted to the second slit 35.

Figure 3:
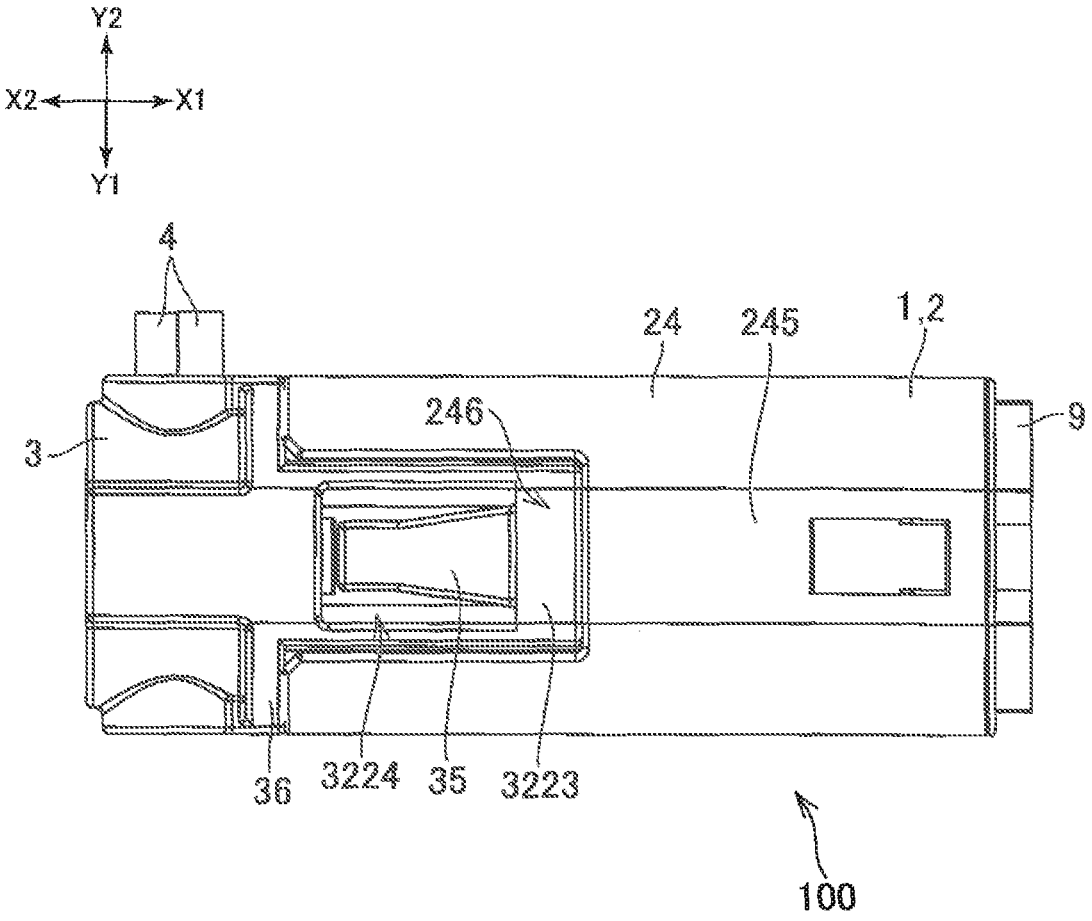
FIG. 3 is a bottom view illustrating the connector assembly 100.

As illustrated in FIG. 3 and FIG. 8, the hood portion 32 of the cover 3 may have a plate-spring portion 36. In the present embodiment, the plate-spring portion 36 is provided on an inner side of a hole 3224 formed in the lower plate portion 322 on the lower side of the hood portion 32. Not being limited thereto, the plate-spring portion 36 may be formed in the upper plate portion 321 on the upper side of the hood portion 32. The plate-spring portion 36 may be linked with the hood portion 32 (particularly, the lower plate portion 322) of the cover 3 via a linking portion 361, and another portion excepting the linking portion 361 may be disposed on the inner side of the hole 3224. By this, the plate-spring portion 36 can deflect in the up-down direction with the linking portion 361 as a fulcrum.

Figure 12:
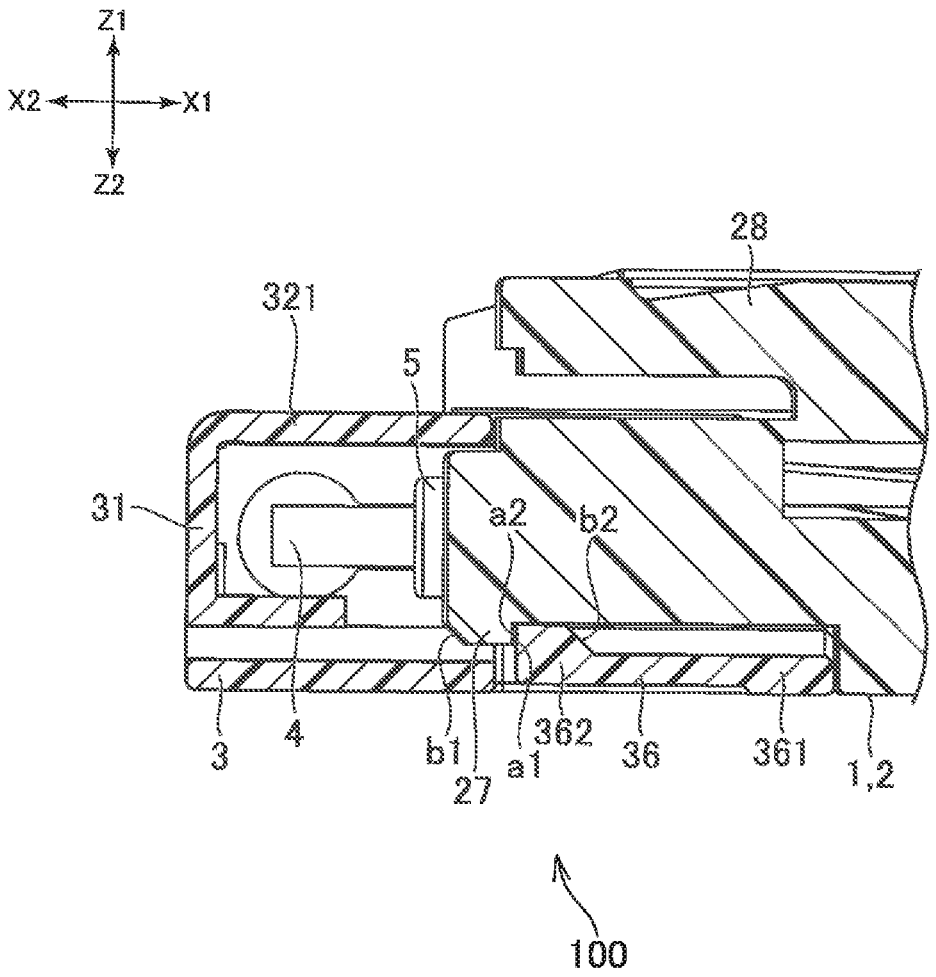
FIG. 12 is a diagram illustrating a cross section at line XII-XII illustrated in FIG. 2.

As illustrated in FIG. 12, the plate-spring portion 36 of the cover 3 may, by engaging the housing 2, lock the cover 3 to the housing 2 so the cover 3 does not disengage from the housing 2. More specifically, the housing 2 may have an engaged portion 27 and the plate-spring portion 36 may have an engaging portion 362 that engages the engaged portion 27. Here, the engaged portion 27 and the engaging portion 362 may respectively have wall faces a1, a2 that oppose each other. Moreover, the engaged portion 27 of the housing 2 may be formed with an inclined face b1 extending in a diagonal direction heading toward the installation direction wherein the cover 3 is installed (in the present embodiment, frontward) and heading toward a direction of an outer side of the housing 2 (in the present embodiment, downward) and the engaging portion 362 of the cover 3 may be formed with an inclined face b2 extending along a direction substantially identical to that of the inclined face b1. By forming the inclined faces b1, b2 in this manner, when the worker installs the cover 3, the engaging portion 362 can move over the engaged portion 27 and the worker can move the engaging portion 362 to a normal position (see FIG. 12) of engaging the engaged portion 27.

As illustrated in FIG. 3, in a state where the cover 3 is installed to the housing 2, the outer shell portion 24 of the housing may expose a portion of the hood portion 32 of the cover 3 formed with the plate-spring portion 36. By this, the worker can deflect the plate-spring portion 36 using a jig or the like to release the engagement of the engaging portion 362 to the engaged portion 27 of the housing 2 and remove the cover 3 from the housing 2.

As illustrated in FIG. 8, the plate-spring portion 36 may be formed as a cantilever extending in the removing direction of the cover 3 (in the present embodiment, rearward) from the linking portion 361 linked with the cover 3. Note that the plate-spring portion 36 may be formed in a tapered shape where a width of a tip is narrower than a width of the linking portion 361. By the plate-spring portion 36 extending in the removing direction of the cover 3 in this manner, in a situation where, for example, a water flow flowing in a direction wherein the cover 3 is disengaged strikes the plate-spring portion 36, because the engaging portion 362 is pushed toward the housing 2, the wall face a2 of the engaging portion 362 acts to abut the wall face a1 of the housing 2, making the engaging portion 362 less likely to disengage from the engaged portion 27 of the housing 2. That is, the cover 3 disengaging from the housing 2 in a situation where a water flow strikes the cover 3 in the removing direction of the cover 3 can be prevented. Moreover, in a situation where a water flow flowing in a direction of pushing the cover 3 to the housing 2 strikes the plate-spring portion 36, the water flow intrudes from an edge of the engaging portion 362 and attempts to push up the engaging portion 362. That is, the water flow acts to separate the wall face a2 of the engaging portion 362 from the wall face a1 of the housing 2 and the engaging portion 362 has a possibility of separating from the engaged portion 27 of the housing 2. However, because in this situation the water flow pushes the cover 3 to a housing 2 side that is the installation direction thereof (in the present embodiment, frontward), the cover 3 does not disengage from the housing 2.

Figure 6:
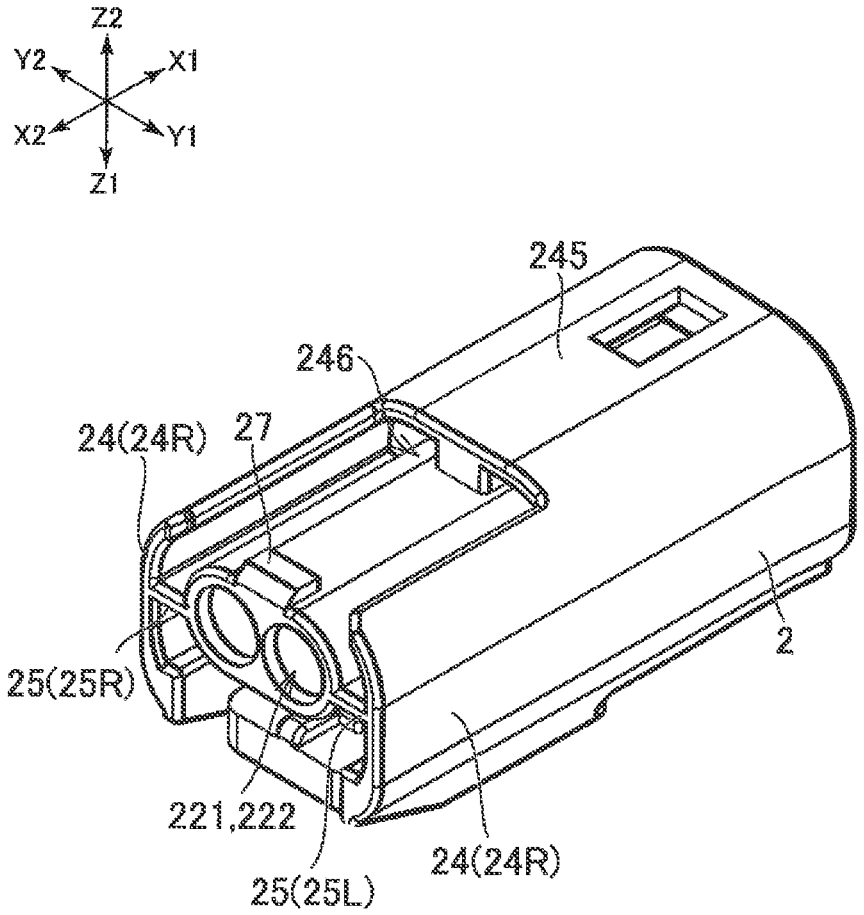
FIG. 6 is a perspective view illustrating a lower side of the housing 2.

As illustrated in FIG. 8, in the present embodiment, the cover 3 has a convex portion 3223 protruding from the lower face 3221 of the lower plate portion 322 along a direction (in the present embodiment, the up-down direction) perpendicular to the installation direction and the removing direction of the cover 3. Moreover, the plate-spring portion 36 is disposed on the inner side of the hole 3224, which is formed along a protruding direction of the convex portion 3223. Moreover, in the present embodiment, as illustrated in FIG. 3 and FIG. 6, the outer shell portion 24 of the housing 2 has a concave portion 246 whereto the convex portion 3223 of the cover 3 is fitted. In the present embodiment, the concave portion 246 is configured as a notch disposed in a rear end of the outer shell portion 24. More specifically, the housing 2 is formed with a bottom portion 245 connecting the left and right outer shell portions 24L, 24R and the concave portion 246 is configured by a rear end of the bottom portion 245 and lateral ends of the left and right outer shell portions 24L, 24R. By the convex portion 3223 of the cover 3 being fitted to the concave portion 246 of the housing 2, the worker can confirm that the cover 3 is installed in a correct position. However, the cover 3 does not necessarily have to have the convex portion 3223. In this situation, the outer shell portion 24 of the housing 2 does not have to have the concave portion 246. Note that the convex portion 3223 of the cover 3 may disposed on substantially the same plane as the bottom portion 245 of the housing 2. Here, by having a front end of the convex portion 3223 of the cover 3 about the rear end of the bottom portion 245 of the housing 2, the cover 3 can be prevented from being inserted excessively into the housing 2. Moreover, the concave portion 246 may be formed as a concavity covering an entire lower face of the convex portion 3223 of the lower plate portion 322.

Moreover, in the present embodiment, the lower plate portion 322 of the cover 3 has a second convex portion 37 protruding downward from a position rearwardly away from the lateral face 3222 and the second convex portion 37 abuts a front end of the left and right outer shell portions 24L, 24R of the housing 2. This can also prevent the cover 3 from being inserted excessively into the housing 2. However, the lower plate portion 322 does not necessarily have to have the second convex portion 37.

Figure 2:
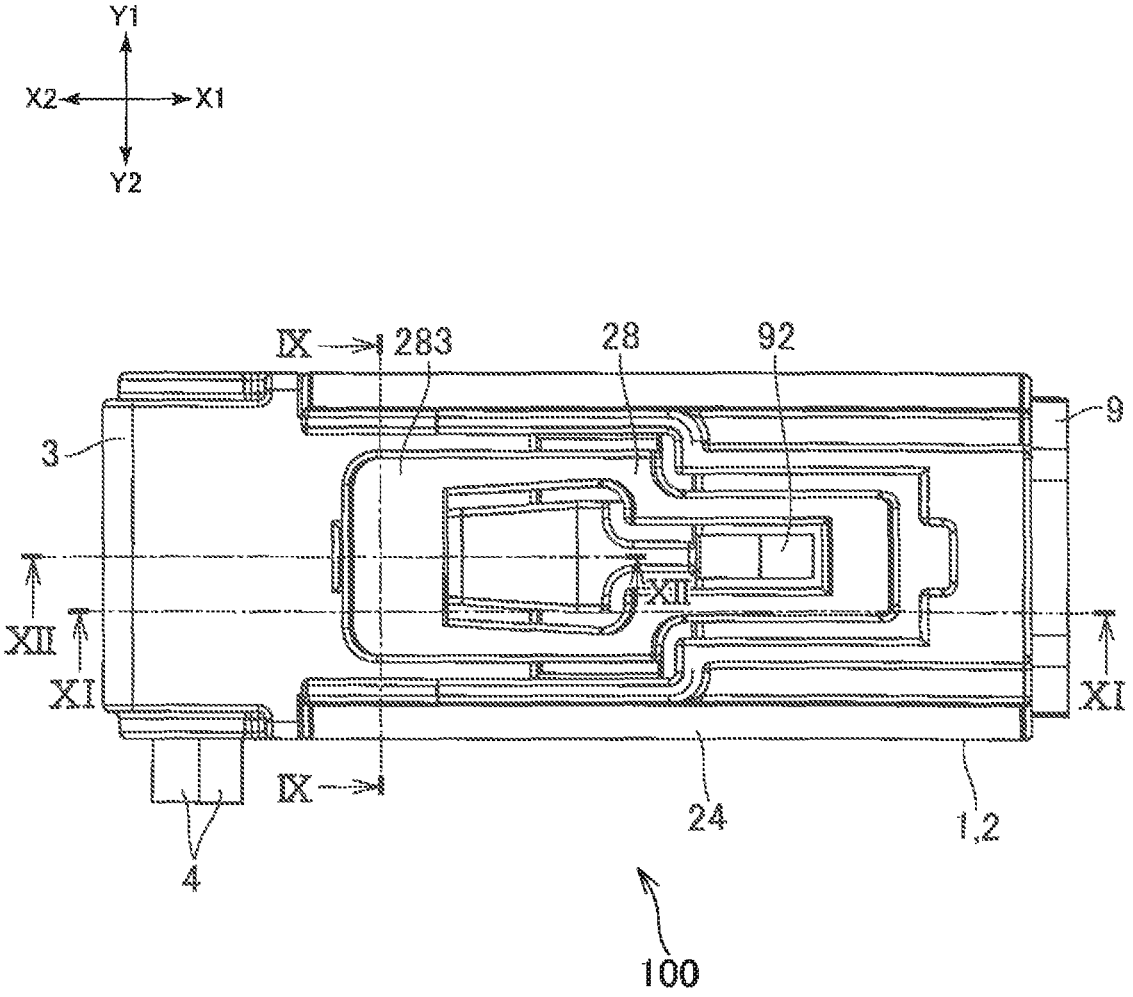
FIG. 2 is a top view illustrating the connector assembly 100.

As illustrated in FIG. 2, in the present embodiment, the housing 2 has a lever 28. In the present embodiment, the lever 28 is disposed between the left and right outer shell portions 24L, 24R. Moreover, in the present embodiment, the lever 28 is disposed on an upper side of the housing 2. However, the housing 2 does not necessarily have to have the lever 28. Moreover, a disposition position of the lever 28 is not limited thereto. For example, the lever 28 may be disposed below the housing 2.

As illustrated in FIG. 11, the lever 28 may extend along the front-rear direction and have along this extending direction a support portion 281 connected to the terminal housing portion 21. In this situation, the lever 28 can elastically deform in the up-down direction with the support portion 281 as a fulcrum. Moreover, the lever 28 may have an engaging portion 282 that locks the other connector 9 by engaging an engaged portion 92 (see FIG. 4) of the other connector 9 and an operation portion 283 provided for operation by the worker. The engaging portion 282 may be disposed frontward of the support portion 281, and the operation portion may be disposed rearward of the support portion 281. The worker can release the lock on the other connector 9 by moving the engaging portion 282 by pushing down the operation portion 283.

Moreover, in the present embodiment, as illustrated in FIG. 5, the housing 2 has a guard-wall portion 29 surrounding a periphery of the lever 28. The guard-wall portion 29 covers a left side and a right side of the lever 28 except for a location where the operation portion 283 of the lever 28 is disposed. By this, erroneous operation of another portion of the lever 28 other than the operation portion 283 can be prevented. However, the housing 2 does not necessarily have to have the guard-wall portion 29.

As above, the connector assembly 100 according to the present disclosure may have the cover 3 that curves the cable 4 led out from the lead-out portion 22 of the housing 2 in a direction different from the direction wherein the cable 4 is led out. Here, the hood portion 32 of the cover 3 may have the slit 33 where through the cable 4 is inserted. Moreover, the outer shell portion 24 of the housing 2 may be disposed on an outer side of the hood portion 32 of the cover 3 and cover at least a portion of the hood portion 32. By this, disengagement of the cover 3 caused by an external force acting thereon such as being struck by a water flow can be prevented.

Moreover, the plate-spring portion 36 of the cover 3 may engage the engaged portion 27 formed on the housing 2 to lock the cover 3 to the housing 2 so the cover 3 does not disengage from the housing 2. Here, the plate-spring portion 36 may be formed as the cantilever extending from the linking portion 361 in the direction wherein the cover 3 is removed (in the present embodiment, rearward). By this, in a situation where an external force such as a water flow strikes the cover 3, the cover 3 disengaging from the housing 2 can be prevented.

Note that the disclosure of the present specification is only an example; any appropriate change that preserves the gist of the present disclosure and can easily be conceived by a person skilled in the art is included in the scope of the present disclosure. Moreover, widths, thicknesses, shapes, and the like illustrated in the drawings are schematic representations and do not limit interpretation of the present disclosure.

The invention claimed is:

1. A connector assembly, comprising:

a connector having a terminal and a housing, the terminal configured to be installed to a tip of a cable, the housing having a terminal housing portion, which includes a through hole that houses the terminal and an opening which is configured to have a terminal of another connector inserted therethrough, and a lead-out portion, which includes a through hole and an opening, the through hole of the lead-out portion is configured to have the cable inserted therethrough and the opening of the lead-out portion is configured to lead out the cable; and a cover installed to the connector, the cover extends along a first direction that is a lead-out direction of the cable from the lead-out portion, the cover configured to curve the cable in a direction different from the first direction; wherein the cover has a hood portion that covers the lead-out portion, the hood portion having a slit and an extraction port, the slit extending from an end of the hood portion in the first direction to the extraction port, the extraction port being a hole formed through the hood portion which is configured to extract the curved cable therethrough, the extraction port being wider than the slit, the housing has an outer shell portion that is disposed on an outer side of the hood portion of the cover and covers at least a portion of the hood portion, and the lead-out portion and the outer shell portion are connected by a rib extending along the first direction, the rib being disposed to pass through the slit.

2. The connector assembly according to claim 1, wherein the hood portion of the cover has a first plate portion and a second plate portion positioned away from the first plate portion interposing the slit, and the outer shell portion of the housing covers at least a portion of the first plate portion of the cover and at least a portion of the second plate portion of the cover.

3. The connector assembly according to claim 1, wherein the hood portion further has a plate-spring portion that engages an engaged portion formed on the housing and locks the cover to the housing so the cover does not disengage from the housing, and the plate-spring portion has a linking portion linked with the hood portion and an engaging portion that engages the engaged portion and the spring portion is formed as a cantilever extending from the linking portion in the removing direction.

4. The connector assembly according to claim 3, wherein the outer shell portion of the housing exposes a portion of the hood portion formed with the plate-spring portion.

5. The connector assembly according to claim 1, wherein the hood portion further has a plate-spring portion that engages an engaged portion formed on the housing and locks the cover to the housing so the cover does not disengage from the housing, the hood portion of the cover further has a convex portion that is provided with the plate-spring portion and protrudes along a direction perpendicular to the removing direction, and the outer shell portion of the housing further has a concave portion whereto the convex portion is fitted.

6. The connector assembly according to claim 1, wherein the hood portion of the cover further has a second slit extending along the removing direction, and the housing further has a second rib that extends along the removing direction and is fitted to the second slit.

7. The connector assembly according to claim 1, further comprising: the other connector that engages the housing; and the cable extending along the first direction from the lead-out portion.

* * * * *